US005261839A

United States Patent [19]

Franks, Jr.

[11] Patent Number: 5,261,839

[45] Date of Patent: Nov. 16, 1993

[54] ANGLED ELECTRICAL CONNECTOR

[76] Inventor: George J. Franks, Jr., 664 Thompson Cir., Inverness, Ill. 60067

[21] Appl. No.: 983,497

[22] Filed: Nov. 30, 1992

Related U.S. Application Data

[63] Continuation-in-part of Ser. No. 829,126, Jan. 31, 1992, Pat. No. 5,180,317.

[51] Int. Cl.[5] ..... H01R 13/00

[52] U.S. Cl. ..... 439/669

[58] Field of Search ..... 439/476, 582, 675, 668-690, 439/695

[56] References Cited

U.S. PATENT DOCUMENTS

| | | | |
|---|---|---|---|
| 1,970,149 | 8/1934 | Pugh, Jr. | 439/669 |
| 2,238,834 | 4/1941 | Travers | 439/669 |
| 3,435,163 | 3/1969 | Bailey et al. | 439/668 |
| 4,647,127 | 3/1987 | Weingartner | 439/289 |

*Primary Examiner*—Joseph H. McGlynn
*Attorney, Agent, or Firm*—Jenner & Block

[57] ABSTRACT

A right angle shielded connector includes an elongated shaft having connector surfaces and an opposite head portion which is integrally formed with a shell cap forming a box-like hollow interior. An insulated sleeve mounts within the hollow interior to space and electrically isolate a terminal which extends out a side opening of the box-like cap. The sleeve along with a mounting bushing forms an interior support to allow the elongated shaft to be press fit into the terminal for assembly by the manufacturer. A cylindrical threaded cover bushing screws onto the threaded side opening of the box-like shell and snugly thereagainst to form a shielded connector. Prior art right angle connectors are also illustrated in which the shell cap are formed from two halves of a cover which mate together.

21 Claims, 2 Drawing Sheets

Fig. 4 PRIOR ART
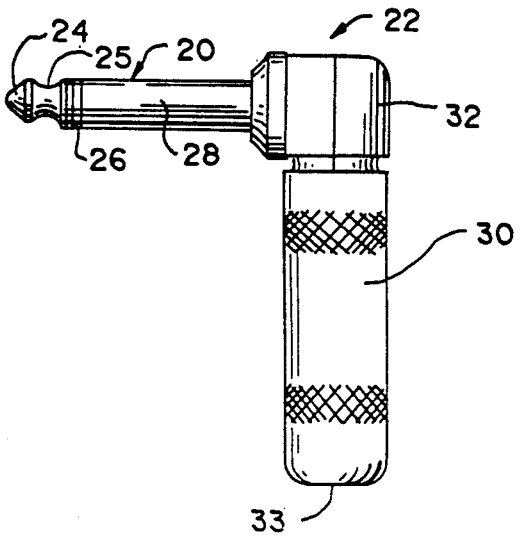
Fig. 6 PRIOR ART
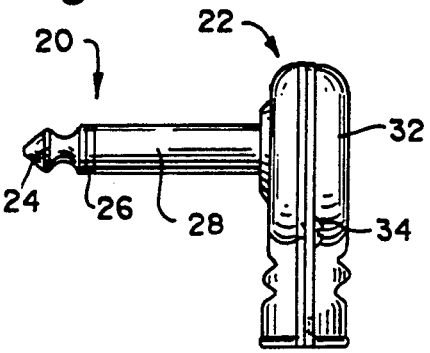
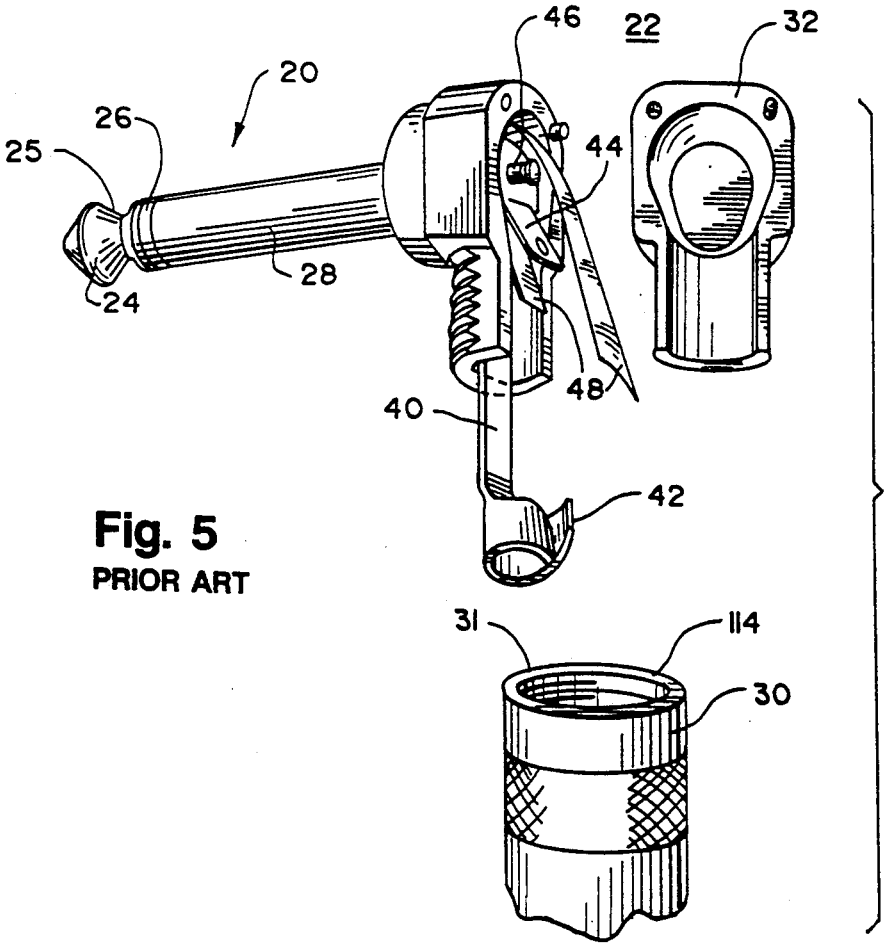
Fig. 5
PRIOR ART

ANGLED ELECTRICAL CONNECTOR

This application is a continuation-in-part of copending application Ser. No. 07/829,126 filed Jan. 31, 1992, now U.S. Pat. No. 5,180,317.

FIELD OF THE INVENTION

This invention relates to an electrical connector for terminating an electrical cable having one or more conductors, and is particularly useful for a right angle connector plug in which the elongated shaft is skewed at an angle to a threaded bushing and the cable which extends therefrom. More specifically, the invention relates to an improved electrical connector, such as a shielded connector, which is structurally strong and easily assembled during the manufacturing operation as well as by the end user.

BACKGROUND OF THE INVENTION

The interconnection of various electronic and electrical systems typically requires that a cable containing one or more conductors terminates in an electrical connector which removably mates with a receptacle. Examples of electrical connectors are quarter-inch phone plugs having an elongated male shaft which is plugged into a female jack having connectors for mating engagement with surfaces on the shaft. Often it is desirable that the elongated shaft be at an angle such as 90° to the threaded shield so that the inserted plug does not protrude much beyond the jack bearing panel. Because of their manner of use, right angle connectors often have increased stress caused by insertion and removal forces as contrasted with the standard in-line configuration in which the elongated shaft and the threaded shielded bushing and extending cable are coaxial. They also are more prone to breakage than an in-line connector.

Conventional right angle connectors are typically formed by a housing formed from separate pieces which are joined together. One of the pieces may be integral to the elongated shaft. These separate pieces may each contain a partial annular thread and when mated together hold the individual pieces. However, such a structure is more liable to breakage, forms a less effective shield, and the increased number of parts are individually and collectively less structurally sound than is desirable. Also, the number of pieces of the plug which must be assembled by the end user after connection is made to a cable should be minimized particularly to reduce labor costs in industrial and commercial applications. Unfortunately, these requirements often conflict with the need to form a structurally secure right angle connector.

SUMMARY OF THE INVENTION

In accordance with the present invention, a novel angled electrical connector is disclosed that is mechanically strong, easily assembled and minimizes the number of parts which the end user needs to assemble after connecting a cable to the connector. The cap housing is substantially more solid than has been typical in the prior art, and is structurally more sound and forms a better shield. The end user needs to join only one piece after connecting a cable to the connector terminals, as contrasted with three or more pieces in many right angle connectors.

The present electrical connector is particularly adapted to form a shielded plug, such as a quarter-inch audio phone plug or the like. However, the improved connector is useful whether or not the plug is to be shielded, and reduces the forces which cause breakage and difficulty in assembly. The connector is easily assembled during the manufacturing process and yet results in an improved structure.

BRIEF DESCRIPTION OF THE DRAWINGS

FIG. 4 is a side elevational view of a prior art type of right angle connector;

FIG. 5 is a partially exploded perspective view of the prior art connector of FIG. 4; and FIG. 6 is a side elevational view of another embodiment of prior art connector.

DESCRIPTION OF THE PREFERRED EMBODIMENT

Figure 1:
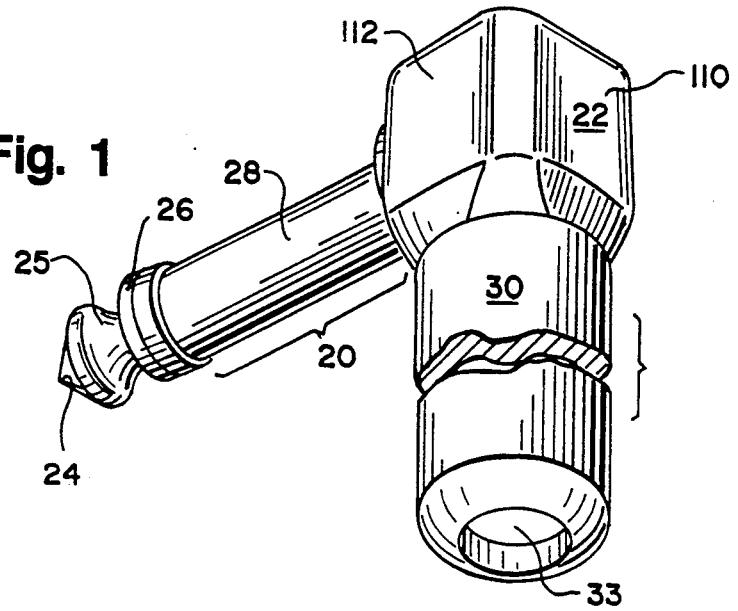
FIG. 1 is a perspective view of a right angle connector according to the present invention.
Figure 2:
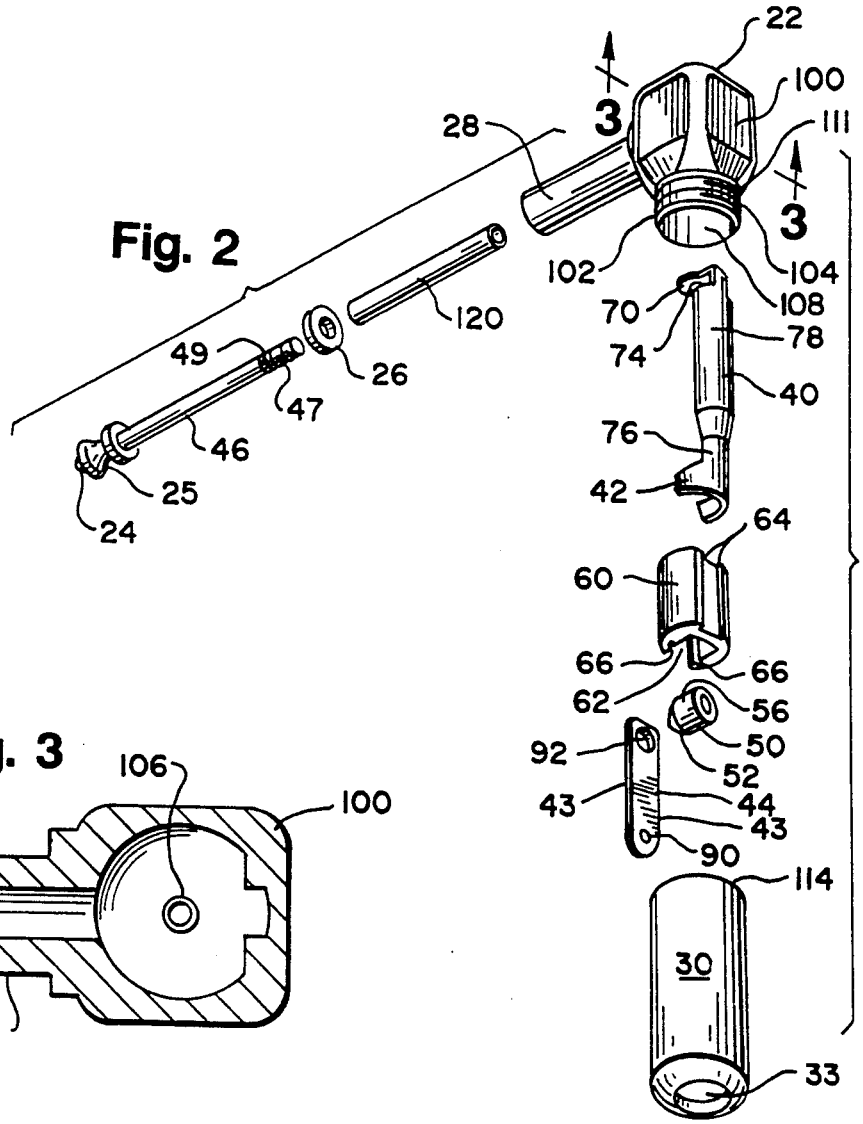
FIG. 2 is a partially exploded perspective view of the connector of FIG. 1.
Figure 3:
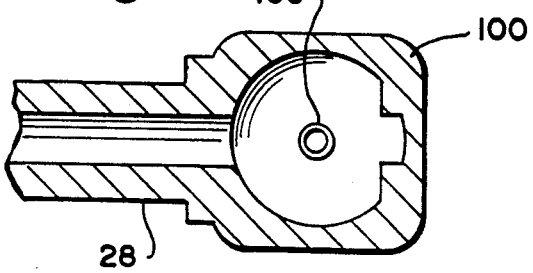
FIG. 3 is a partial sectional elevation taken along lines 3—3 of FIG. 2.

FIGS. 1–3 illustrate a novel electrical connector embodied in a right angle phone plug which is used to connect an electrical cable to a jack or receptacle of standard design. FIGS. 4–6 illustrate right angle phone plugs which are typical in the prior art. All such electrical connectors typically include an elongated connector assembly 20 which extends from a shell or cap assembly 22 which contains therein at least one terminal which can be soldered to an electrical conductor of a cable (not illustrated). The cable may be a shielded cable in which a center wire conductor extends through a surrounding shield which is to be connected to the cap assembly 22, or alternatively, the cable could contain a plurality of electrical conductors.

The elongated connector assembly 20 has a terminating tip end 24 with a detent groove 25 spaced from the tip end which forms one electrical contact which mates with a contact in the receiving jack. A detent spring on the jack engages the groove 25 as is conventional. Adjacent the tip end 24 is an annular spacer or insulator 26 which electrically isolates the tip from an annular hollow outer shaft 28 which forms a second electrical contact surface. The receptacle jack, as is well known, includes contacts which engage the shaft 28 in order to electrically connect the plug to circuitry to which the receptacle jack is attached.

While a right angle audio connector of the shielded type is illustrated, in which the contact tip 24 is connected to a center wire of a shielded cable, and the surrounding shaft 28 and cap assembly 22 are formed of metal and are electrically connected to the shield of the cable, other types of electrical connectors are suitable for use with the invention. For example, the elongated connector assembly 20 may have additional electrical contact surfaces separated by additional insulators in order to form a connector for a multiple wire cable.

In both the novel connector of FIGS. 1–3 and the prior art embodiments of FIGS. 4–6, the cap assembly 22 is threaded onto a metal annular cover or bushing 30. The bushing 30 is a hollow cylindrical shape having interior threads 31 (see FIG. 5) adjacent one open end thereof. A circular aperture 33 is located at the other end for the cable to extend into the bushing 30. Such a threaded bushing 30 may be identical to the form used with an in-line connector. This provides economies of scale in the manufacturing process as well as bushing parts which are interchangeable for a family of in-line and right angle connectors.

In typical prior art connectors such as seen in FIGS. 4-5 and FIG. 6, the cap assembly 22 is often formed of two parts or halves, the front of which is joined to or may be an integral part of the elongated connector assembly 20. A rear half 32 mates to the front half and may be connected thereto in a variety of manners. In the connector of FIGS. 4-5, the front half and the rear half each form about one half of an exterior threaded cylinder. When abutted together, the external threads form a complete cylinder which is held together by the bushing 30 when threaded onto the abutting pieces. In the type of prior art connector shown in FIG. 6, the rear cover 32 is secured to the front cover by a pair of screws 34. Typically, the connector of FIG. 6 does not form as good a shield as the other connectors but it is more inexpensive to manufacture. In addition, the screws 34 or other fasteners can be lost and are more labor intensive for the end user to assemble together after the cable has been secured to the terminals located inside the cover.

The right angle connector of FIGS. 1-3 and the prior art right angle connector of FIGS. 4-5 each include a long terminal 40 having a clamp or crimp end 42 which may be connected to the shield conductor of the cable. The center wire of the cable is connected to a short terminal 44 which mechanically and electrically connects to an inner shaft 46 which extends within the hollow outer shaft 28 to the front terminal tip 24. The inner shaft 46 is of reduced diameter and electrically isolated from the outer surrounding shaft 28 and extends down the hollow center thereof into engagement with the tip end 24 and may be formed as an integral part of the tip 24. The opposite end of the inner shaft 46 is staked to the short terminal 44 or is otherwise in contact to mechanically and electrically join them together. A pair of insulating ribbons 48, seen only in FIG. 5, may be used if desired to aid in electrically isolating the terminal 44 and the center wire of the cable when soldered thereto from the surrounding metal cap assembly 22. The electrical connectors, to the extent described above, are generally conventional and may be varied as is known.

The aspects which are novel with respect to the prior art and further details of the construction will now be explained. The elongated connector assembly 20 of FIGS. 1-3 includes an outer shaft 28 that is integral with the shell assembly or cap 22. A cylindrical aperture extends through the entire outer shaft 28 to create the hollow interior through which the inner shaft 46 extends in spaced relationship to the outer shaft 28.

The long terminal 40 is formed of a metal lug and includes a body portion 78, a neck portion 76 and a clamp or crimped end 42 near the neck 76. The body 78 includes at least two surfaces. One surface of the body 78 is of a shape to fit smoothly against the inner surface of the shell assembly or cap 22. The contact between the surface of terminal 40 and the shell assembly or cap 22 provides an electrical contact. Another surface of the body 78 is of a shape so that it fits smoothly against the elongated guide recess 64 of the insulated sleeve 60. The neck 76 is of a reduced size compared to the body 78. This allows the elongated guide recess 64 to pass easily over the neck 76 to make assembly easier. The neck 76 may be bent at a slight angle towards the axis of the shell assembly or cap 22 to position the clamp or crimp end 42 closer to such axis. The long terminal 40 includes a tab 70 which is bent at a right angle to the longitudinal extent of the terminal and towards the connector assembly 20. Centered within the tab 70 is a circular aperture 74.

The short terminal 44 is formed of a lug having a metal lug hole 90 for soldering to the center wire of the cable, and at the opposite end of the lug a circular aperture 92 of a slightly larger diameter than the diameter of the neck 52 of the bushing 50. The short terminal 44 is of a size and shape so that its edges 43 fit snugly within the pair of slots 66 of the insulating sleeve 60.

The insulating sleeve 60 is formed of a nonconducting material in the shape of an elongated partial cylinder having an open slot parallel with the longitudinal extent of the cylinder. Opposite the long slot is an elongated guide recess 64 to guide, support and position the long terminal 40. The insulating sleeve 60 also contains a pair of slots 66 extending along the open slot of the cylinder 60 to form a second guide support to guide, position and support the short terminal 44 when slid into the pair of slots 66. The insulating sleeve 60 is of a size and shape to snugly fit in the interior of the shell assembly or cap 22 and the pair of slots 66 are located inwardly from the edge of the sleeve to maintain the short terminal 44 spaced from and thereby electrically isolated with respect to the metal cap 22, the long terminal 40 and the metal conducting bushing 30 when it is screwed onto the shell cap 22. The open slot of the insulating sleeve 60 creates a space 62 which accepts a mounting bushing 50.

The mounting bushing 50 has a neck portion 52 and a shoulder portion (not shown). The bushing 50 may be formed of an electrically conductive material. The diameter of the neck portion is slightly smaller than the aperture 92 in the short terminal 44 and extends into the aperture 92 such that the shoulders (not shown) of the bushing 50 abut the portion of the short terminal 44 surrounding the aperture 92. The body 56 of the bushing 50 is of a size and shape to snugly fit in the open space 62 in the insulating sleeve 60. The neck 52 of the bushing 50 includes a receptacle (not shown) of a diameter just slightly smaller than the diameter of the neck portion 47 of the inner shaft 46. This receptacle may pass through both the neck 52 and the body 56.

The shell assembly or cap 22 consists of an upper hollow housing 100 of generally cube shape. Defining the generally cube shape is a rear wall 110 which is opposite to the front extending elongated shaft 28, and side walls 112. The interior of the hollow housing 100 is generally box-like, in that it surrounds and generally encloses a space. While the exterior side walls are illustrated as flat, they may be arcuate. Likewise, the interior surface may be flat, arcuate or other shapes, all of which are intended to be covered by the phrase box-like. The shell assembly or cap 22 may be made of an electrically conductive material such as metal. The side walls 112 surround and define an annular side opening 108 that is generally normal to the elongated shaft 28. Integrally formed therewith is a lower generally cylindrical member 102 containing exterior threads 104 which mate with the interior threads located in the hollow bushing 30. Thus, the rear wall 110 and side walls 112 are integrally formed of solid metal to form an electrical shield surrounding the box-like interior with the shield being open at the side annular member 102 which will mate with the metal bushing 30 to form the finally assembled right angle connector.

On the interior of the shell cap 22, opposite the opening 108, extends a protrusion 106, see FIG. 3, of generally cylindrical shape and of the same or slightly smaller diameter as the circular aperture 74 in the tab 70 on the long terminal 40. The protrusion 106 serves to secure and key together the long terminal 40 to the cap 22, as will appear.

The elongated connector assembly 20 includes an insulating collar 120 in the shape of a hollow tubular shaft which is placed over the inner shaft 46. The internal diameter of this insulating collar 120 is slightly larger than the diameter of the inner shaft 46. The outer diameter of this insulating collar 120 is less than that of the inner diameter of the outer shaft 28. The length of the insulating collar 120 is sufficiently long to prevent electrical contact between the inner shaft 46 and the outer shaft 28. The insulating ring 26 is formed of a non-conducting material in the shape of a donut and is placed around the inner shaft 46 near the tip 24. The insulating ring 26 ensures that no physical or electrical contact is made between the tip 24 and the outer shaft 28.

During assembly by the manufacturer of the plug, the long terminal 40 is placed inside the hollow cap 22 with the aperture 74 being placed over the protrusion 106 and then staked thereto. Next, the insulating sleeve 60 is placed in the cap 22 so that the guide recess 64 in the insulating sleeve 60 fits smoothly against one surface of the long terminal 40. Meanwhile, the neck portion 52 of the mounting bushing 50 is placed in the aperture 92 in the short terminal 44. The shoulder portion (not shown) of the bushing 50 abuts the portion of the short terminal 44 surrounding the aperture 92. Then, the combination of the short terminal 44 and the bushing 50 is placed within the insulating sleeve so that the edges of the short terminal 44 fits snugly within the pair of slots 66 and the assembly is slid into the groove until the bushing 50 is fully within the cap 22. The center of the aperture 92 of the short terminal 44 lies along the center longitudinal axis of the outer shaft 28.

The elongated connector assembly 20 is now completed and finally assembled into the cap 22. The insulating ring 26 is placed around the inner shaft 46 near the tip 24. The insulating collar 120 is placed over the inner shaft 46 to at least partially surround the inner shaft 46. The inner shaft 46, with the insulating ring 26 and the insulating collar 120, is then placed through the outer shaft 28 along the longitudinal axis of the outer shaft 28. The neck portion 47 of the inner shaft 46 is positioned through the aperture 92 of the short terminal 44 and into the mating receptacle (not shown) in the neck 52 of the bushing 50 to secure together the inner shaft 46 and the bushing 50 with the short terminal 44 being sandwiched therebetween and connected to both. The inner shaft 46 is thus press-fit into the bushing 50.

The rear wall 110 of the shell cap provides a firm and unyielding support for the press-fit operation through the intermediaries of the long terminal 40 and insulating sleeve 60, the mounting bushing 50 and the short terminal 44. Once the inner shaft, 46, the bushing 50 and the short terminal 44 are secured together, the shoulder 49 of the inner shaft 46 abuts the front of the short terminal 44, and the shoulder (not shown) of the bushing 50 abuts the rear of the short terminal 44. The short terminal 44 is thus in electrical contact with the inner shaft 46.

Preferably, the bushing 50 is made of metal or other electrically conductive material, so that the bushing 50 supplies a greater surface area for electrically connecting the inner shaft 46 to the short terminal 44. The sleeve 60 and bushing 50 thus form a mounting device to support and prevent the end of the short terminal 44 from moving rearwardly toward rear wall 110 as the connector neck 47 is press fit rearwardly into final engagement with the short terminal 44.

After assembly by the manufacturer, the customer or end user is in effect supplied with a two-piece connector consisting of the assembled shell assembly 22, and the separate threaded bushing cover 30. When the customer desires to use the connector, the cable is placed through hole 33 of the bushing cover 30 and the center wire of the cable is soldered within aperture 90 of the short terminal 44. The outer shield may be crimped by the clamp 42 or otherwise soldered or connected to the long terminal 40. The bushing cover 30 is then screwed onto the exterior threads 104 which serves as an interconnection surface until the top annular rim 114 of the bushing cover 30 abuts the annular seat 111 of the upper housing 100. Since the bushing 30 as well as the shell assembly or cap 22 and outer shaft 28 are all formed of conductive metal, a good shield is formed for the inner wire of the cable once the bushing 30 is tightly screwed against the bottom seat surfaces of the joined shaft assembly.

The integral shell assembly 22 and outer shaft 28 is substantially more solid than prior cap housing units. The threads 104 extend completely around the circumference of the lower annular member 102 to form a complete and uninterrupted cylinder, unlike the typical prior art connectors which have interruptions in the threaded interconnection member. The structure created is fairly rigid and is stronger than the typical prior art devices. The strength of the integral shaft connector and cap housing assembly helps to reduce breakage. The part count of pieces for final assembly by the end user or customer has been reduced to two, namely, the assembled cap and the bushing cover 30. Also, the novel shell assembly 22 is more solid and forms a better shield than prior art caps 22 as seen in FIGS. 4–6 in which a split occurs in the top of the cap caused by separate pieces or halves which must be mated together.

While the connector has been shown for a typical shielded audio plug having a pair of contacts 24 and 28 along an elongated shaft, it will be appreciated that numerous variations can be made. The electrical conductor can be used with or without a shielded cable as desired. The connector can be made in male or female form and for cables using one or multiple conductors. The bushing 50 and short terminal 44 could be an integral unit, further reducing the number of components required to assemble the connector. Other changes are intended to be within the spirit of the invention and can be made by one skilled in the art.

What is claimed is:

1. A right angle electrical connector, comprising:

a connector assembly having an elongated shaft for mating contact with a receptacle and extending from a front portion of a shell cap having rear and side walls surrounding a generally hollow space to define a box-like interior, the rear and side wall forming a side opening extending normal to the elongated shaft, at least the rear and side walls being integrally formed of solid metal to form an electrical shield surrounding the box-like interior with the shield being open at the side opening, at least one terminal located at least partially within the hollow interior space and extending at generally a right angle to the elongated shaft and through the side opening to a connector end, and a bushing member formed of metal of elongated shape for mating engagement with the side opening and extending generally at a right angle to the elongated shaft and generally surrounding the terminal connector end to form an electrically shielded housing for the terminal.

2. The electrical connector of claim 1 wherein the shell cap includes an inner surface that is electrically conductive and a second terminal spaced from the first named terminal and including a tab with an aperture located over the protrusion to key together electrically and mechanically the second terminal and the shell assembly.

3. The electrical connector of claim 1 wherein the elongated shaft comprises an elongated outer shaft formed of metal and in contact with the shell cap and an inner shaft spaced from the outer shaft and extending to a shaft end, and the terminal having a terminal end opposite the connector end and in mating contact with the shaft end.

4. The electrical connector of claim 2 wherein the elongated outer shaft is integrally formed of solid metal with the front portion of the shell cap and with the rear and side walls to form the electrical shield surrounding the box-like interior.

5. The electrical connector of claim 1 including a mounting means located within the hollow space in the shell cap and having a guide surface abutting a portion of the terminal to support and prevent movement of an end of the terminal within the interior of the shell cap.

6. The electrical connector of claim 5 wherein the mounting means includes a bushing located to the rear of the terminal end and in mating abutment with the terminal end to prevent rearward movement of the terminal end.

7. The electrical connector of claim 6 wherein the bushing is formed of electrically conductive metal so that the bushing serves to increase the electrical contact area in mating abutment with the terminal end.

8. The electrical connector of claim 5 wherein the mounting means includes an elongated sleeve having a guide surface which extends along the terminal and in abutment with the terminal to form an elongated support for the terminal.

9. The electrical connector of claim 8 wherein the sleeve is formed of insulated material and the elongated guide surface is spaced inwardly of an edge of the sleeve to space the terminal away from the shell assembly and thereby electrically insulate the terminal from the shell assembly.

10. The electrical connector of claim 8 including a second terminal extending at a right angle with respect to the elongated connector assembly and through the side opening, and the sleeve has a second elongated guide surface to mount the second terminal in spaced relationship to the first named terminal.

11. The electrical connector of claim 8 wherein the sleeve includes a pair of slots forming a pair of elongated guide surfaces, and the terminal slides into the pair of slots and is held thereby against movement normal to the longitudinal extent of the pair of slots.

12. The electrical connector of claim 11 wherein the sleeve is formed of insulated material and the pair of elongated guide surfaces are spaced inwardly from an exterior surface of the sleeve to space the terminal away from the shell assembly and thereby electrically insulate the terminal from the shell assembly.

13. A right angle electrical connector, comprising:

an elongated connector assembly having an elongated shaft extending rearwardly to a shaft end, a shell assembly having a hollow interior which generally surrounds the shaft end and a side opening with an interconnection surface, a terminal having a terminal end in electrical contact with the shaft end and having a portion extending at a right angle with respect to the elongated connector assembly and through the side opening, mounting means located within the interior of the shell assembly and having a guide surface abutting the terminal portion to support and prevent movement of the terminal end within the interior of the shell assembly, and a cover member for mating engagement with the interconnection surface of the shell assembly to form a housing which extends generally at a right angle to the elongated connector assembly and generally surrounds the terminal.

14. The electrical connector of claim 13 wherein the shell assembly includes an inner surface that is electrically conductive and includes a protrusion extending into the hollow interior, a second terminal spaced from the first named terminal and having a tab with an aperture extending over the protrusion to form an electrically conductive connection and that keys the second terminal against movement within the shell assembly.

15. The electrical connector of claim 13 wherein the mounting means includes a bushing located to the rear of the terminal and in mating abutment with the terminal to prevent rearward movement of the terminal end.

16. The electrical connector of claim 15 wherein the bushing is formed of electrically conductive metal so that the bushing serves to increase the electrical contact area in mating abutment with the terminal end.

17. The electrical connector of claim 13 wherein the mounting means includes a sleeve having an elongated guide surface in abutment with the terminal portion.

18. The electrical connector of claim 17 wherein the sleeve is formed of insulated material and the elongated guide surface is spaced inwardly of an edge of the sleeve to electrically insulate the terminal from the shell assembly.

19. The electrical connector of claim 17 including a second terminal extending at a right angle with respect to the elongated connector assembly and through the side opening, and the sleeve has a second elongated guide surface to mount the second terminal in spaced relationship to the first named terminal.

20. The electrical connector of claim 17 wherein the sleeve includes a pair of slots forming a pair of elongated guide surfaces, and the terminal slides into the pair of slots and is held thereby against movement normal to the longitudinal extent of the pair of slots.

21. The electrical connector of claim 20 wherein the sleeve is formed of insulated material and the pair of slots are spaced inwardly from an exterior surface of the sleeve which abuts the shell assembly to thereby electrically insulate the terminal from the shell assembly.

* * * * *